United States Patent [19]

Hofmann

[11] 4,100,836

[45] Jul. 18, 1978

[54] COMBUSTION CHAMBER SYSTEM FOR THE PRODUCTION OF PROPELLING GASES

[75] Inventor: Heinrich Hofmann, Gröbenzell, Germany

[73] Assignee: Messerschmitt-Bölkow-Blohm Gesellschaft mit beschränkter Haftung, Munich, Germany

[21] Appl. No.: 862,638

[22] Filed: Sep. 22, 1969

[30] Foreign Application Priority Data

Aug. 21, 1968 [DE] Fed. Rep. of Germany ..... 1728074

[51] Int. Cl.[2] ..... F41F 1/04

[52] U.S. Cl. ..... 89/7; 89/8

[58] Field of Search ..... 89/1, 7, 8; 60/26.1

[56] References Cited

U.S. PATENT DOCUMENTS

| | | | |
|---|---|---|---|
| 2,981,153 | 4/1961 | Wilson, Jr. et al. | 89/7 |
| 2,986,072 | 5/1961 | Hudson | 89/7 |
| 3,138,990 | 6/1964 | Vukes et al. | 89/7 |

*Primary Examiner*—David H. Brown

*Attorney, Agent, or Firm*—Toren, McGeady and Stanger

[57] ABSTRACT

A combustion chamber system for the production of propelling gases, particularly for propelling projectiles includes a tubular member defining a combustion chamber which is adapted to be located adjacent one end of a gun barrel having a passage for a projectile. A piston is slidable in the combustion chamber toward and away from the projectile and it includes a ring portion of wider diameter which is movable in a widened portion of the tubular member defining the combustion chamber. Propellant components are introduced into the combustion chamber by the movement of the piston which is effected by the combustion of the gases within the combustion chamber. For this purpose, the combustion chamber is connected through passages defined in the piston and fixed end plates of the combustion chamber which extend to supply tanks for the various propellant components. The piston and the end plates also define distributing passages for the propellant components which are cyclicly compressed and expanded by the movement of the piston and thus produce a movement of the propellant components through nozzles defined at the end of the piston end face for injection into the combustion chamber. The apparatus includes additional means for producing pressure within the combustion chamber to cause a braking of the movement of the piston in the return direction and initiate a rapid build-up of the pressure in the combustion chamber for producing a rapid movement of the piston in a working stroke direction.

7 Claims, 4 Drawing Figures

7'
2'
27
28
58'
22
82
23a
23'
84
29
20'
86

25
25a
24

P
P1
x
y
x
y

COMBUSTION CHAMBER SYSTEM FOR THE PRODUCTION OF PROPELLING GASES

SUMMARY OF THE INVENTION

This invention relates in general to the construction of a propelling force producing device, and in particular, to a new and useful differential pressure piston combustion chamber system for the production of propelling gases particularly for fire arms.

The invention deals with a pressure differential piston-combustion chamber system for the production of propelling gases from liquid, particularly hypergolic propellant components, and is particularly suitable for fire arms. The system of the invention includes a guide cylinder for the pressure differential piston which also forms a combustion chamber casing and a receiving chamber for a projectile in the event that the device is to be used with fire arms. The piston closes, on its one face, the inner space of the combustion chamber, and its opposite rear face moves in a chamber defined at the opposite end of the combustion chamber, which forms a propellant distribution chamber; and thus provides means for directing the propellant components through passages into the combustion chamber.

In accordance with U.S. Pat. No. 3,138,990, it is known to provide a rapid fire weapon which is actuated by a pressure differential piston-combustion chamber system. With such a system, the pressure gases which propell the projectile out of the barrel are produced in the combustion chamber by means of two liquid fuel components which react hypergolically with each other. In this construction, the injection of the fuel is initiated at the forward end reversing point of movement of the pressure differential piston and part of the fuel components are conveyed or injected into the combustion chamber by means of the existing pressures of the supply containers or tanks. The reaction of the fuel components produces a combustion pressure build up in the combustion chamber which acts against the front ends of an annular side ring of the piston to move the piston backwardly after it overcomes an initial counterface which is caused by a pressure medium. In so doing, the previously injected fuel components are put under pressure by associated ring members or portions of the pressure differential piston which move in an annular spaces or distribution chambers to cause the components to be directed into the combustion chamber. At the same time check valves or non-return valves are automatically closed in a direction toward the fuel containers. Since the front annular end face of the differential piston which faces to the combustion chamber is larger than the end faces of the ring portions which act on the fuel distribution chambers, a differential action sets in whereby the injection pressure at any given moment is larger than the respective inner pressure of the combustion chamber.

In order to obtain favorable inner ballistic conditions it is, in accordance with the theory of shooting, necessary that the pressure gases which are produced by combustion of the amount of gun powder which is weighed in the cartridges employed conventional fire arms, and which is employed to drive the projectile out of the barrel, must reach a high starting pressure in order to impart to the projectile and an initial acceleration which is large enough so that a high muzzle speed is attained. The known fire arm which operates on a pressure differential combustion chamber principle for producing pressure gases have certain advantages over conventional fire arms including savings in respect to the cartridges less weight, and less sensitivity of the used propellants. However, these known fire arms which operate under this principle have a disadvantage in respect to large initial acceleration, and large muzzle speed. This is because, during the initial stage of movement of the pressure differential piston in the working stroke direction, the injection pressure energy which develops will be only that which is attained from the relatively low fuel supply container pressure. This causes a relatively flat rise of the pressure curve in the pressure-path diagram or in the inner ballistic working diagram. The pressure peak, which is determinitive of a large initial acceleration of the projectile, is thus attained too late and with a loss of time in the form of an undesired staying period which occurs after the combustion chamber pressure starts operating. Therefore, there is an increase in the quantities of the fuel components which are injected.

The present invention provides a construction in which overcomes disadvantages of the prior art and provides a propelling force having a steep pressure increase in the pressure-path diagram making the device suitable for use in a fire arm. This is solved by providing a pre-injection of a partial amount of the propellant components during the end portion of the forward movement of the pressure differential piston which occurs during its return stroke. This is done if necessary by additional injection of a further partial amount of the propellant components during the last portion of the return stroke and during an initial phase of the working stroke movement of the differential piston. By providing a pre-injection, the ignition delay time will still produce an ignition in the end phase of the forward movement of the pressure differential piston so that the ignition delay time will not constitute an unavoidable dead time or lost time. The invention provides an additional important advantage over the prior art in that as soon as the pressure differential piston has reached its front dead end position, a certain pressure will already be built up ahead of it without requiring any delay or staying time of the piston in the front dead end position. Due to this pre-pressuring of the combustion chamber, the differential piston will be pushed backwardly at high speed into the working stroke. Additional fuel is injected through the pressure differential piston into the combustion chamber. The pressure gas cushion which is produced by a pre-injection into the combustion chamber forms a spring which elastically brakes the forward return movement of the piston.

The control of the pre-injection is affected by the movement of the differential piston itself and is advantageously carried out by means of push rods having ends which project into the cylinder space and are contacted by ring portions of the piston and displaced to permit opening of the passages for the particular propellant components so that they are sprayed into the combustion chamber under the container pressure, or the push rods actuate individual injection pumps which spray this propellant components into the combustion chamber under additional pressure. The arrangement is such that there is no lost time in the operation of the differential piston and in addition a greater initial acceleration of the pressure differential piston is carried out and an increase of the shooting frequency is obtained. Due to the advantageous arrangement the constructional length of the combustion chamber may also be shortened.

Accordingly, it is an object of the invention to provide a driving force generating system using a pressure differential piston movable in a combustion chamber by the combustion gases generated between and acting during its movement to pump propellant components into the combustion chamber and also including means for directing an additional amount of propellant components into a combustion chamber just prior to and during an initial portion of movement of the piston in a working stroke.

A further object of the invention is to provide a driving force generating device which is simple in design, rugged in construction, and economical to manufacture.

The various features of novelty which characterize the invention are pointed out with part of this specification. For a better understanding of the invention, its operating advantages and specific objects attained by its use, reference should be had to the accompanying drawings and descriptive matter in which there are illustrated and described preferred embodiments of the invention.

GENERAL DESCRIPTION OF THE PREFERRED EMBODIMENTS

Figure 1:
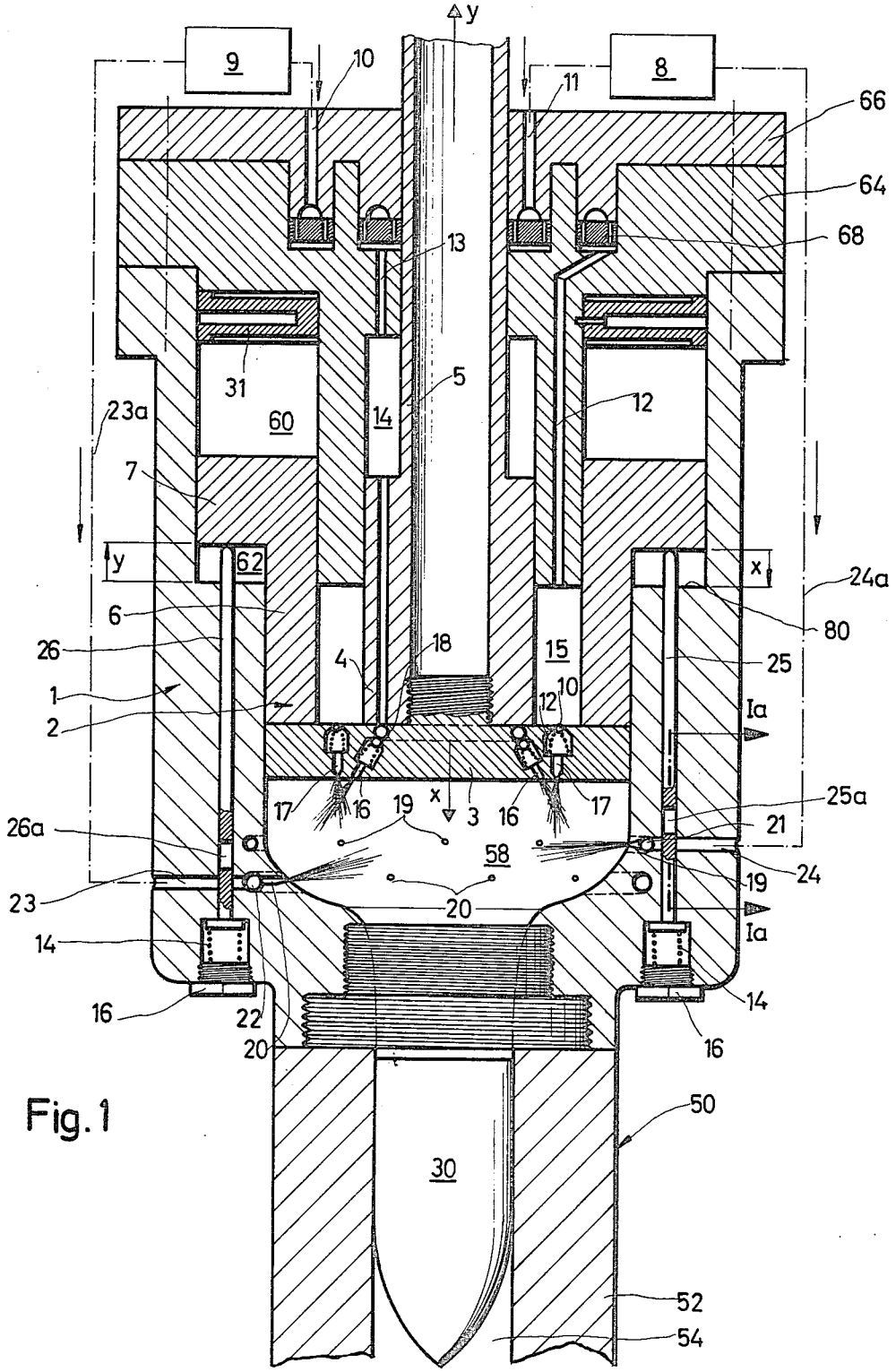
FIG. 1 is an axially sectional view of a fire arm constructed in accordance with the invention.

Referring to the drawings in particular, the invention embodied therein in FIG. 1 comprises a driving force generating system in the form of a fire arm generally designated 50 which includes a barrel portion 52 having a bore or passageway 54 for the passage of a projectile 30. The barrel 52 is formed as an extension or as a separate piece extending outwardly from a tubular member or cylinder generally designated 1 which defines a central combustion chamber 58 and annular differential pressure chambers 60 and 62. The end of the cylinder 1 is closed by a fuel passage plate member 64 and a fuel passage disk 66.

In accordance with the invention, a pressure differential piston 2 is arranged to slide in the combustion chamber 58 and it includes a bottom or end face portion 3 and an annular rear portion or ring 4 which moves in the passages 60 and 62. In addition, the pressure differential piston 2 includes an inner guide pipe portion or cylindrical portion 5 which is spaced radially inwardly from an outer skirt portion 6.

The propellant components, for example, a liquid fuel and an oxygen or an oxygen carrier, are stored in supply containers or tanks 8 and 9, respectively. The respective tanks 8 and 9 are connected, through axially elongated passages 11 and 10, valve means in the form of plate valves 68, and further passages 12 and 13, to respective annular distribution chambers 15 and 14 which vary in size in accordance with the position of the piston 2. The piston bottom 3 carries associated bores and nozzle means 16 and 17 for the fuel and oxygen spray deliveries into the combustion chamber 58. The nozzle means and 16 and 17 include ball valves 70 biased to a closed position by springs 72. The pressure force of the spring 72 is overcome during the upward movement of the piston 2 on a working stroke by the collapsing of the respective annular chambers 15 and 14, for the fuel and oxygen respectively, caused by this upward piston movement. The nozzle means 16 are connected to the supply through an annular passage 18 which is defined in the bottom 3. The discharge of the nozzle means 16 and 17 is oriented obliquely so that the spray streams intersect and provide mixing of the components adjacent the point of introduction to the combustion chamber 58.

In accordance with a feature of the invention a rapid increase in the pressure within the combustion chamber 58 is obtained during the return downward movement of the piston 2 in order to provide a rapid build up for the working stroke in the upward direction. To accomplish this, means are added to the combustion chamber for effecting a rapid build up of a force in the form of a pre-injection or predetermined amount of fuel and oxygen carrier. For this purpose, the walls of the combustion chamber 58 are provided at a plurality of spaced locations around the periphery and above the bottom dead center position with injection bores 19 and 20 which extend obliquely relative to each other in order to provide a whirling impinging effect of the injected propellants. Annular passages 21 and 22 which are defined in the cylinder walls communicate with the individual injection bores 19 and 20 respectively and they are supplied from the propellant containers 8 and 9 through connecting lines 24*a*, 24 and 23*a*, 23 respectively. The passages 24 and 23 are closed by a surface of a respective push rods or central rods 25 and 26 which are slidable in axially extending passages of the cylinder 1. The control rods 25 and 26 project into the annular space 62 and they are contacted by the ring portion 7 of the piston 2 during its downward movement and moved against the force of a spring 74, which is retained over a nut 76 threaded into the cylinder 1, to move the rods downwardly during this downward movement of the piston. When this downward movement occurs associated slot passages 25*a* and 26*a* are moved into alignment with the passages 24 and 23 respectively to open these passage to admit the associated propellant components to be sprayed into the combustion chamber 58.

The operation of the device is as follows:

During the return movement of the differential pressure piston 2, in a downward direction as viewed in the drawings, it reaches the point in the drawings at which is it spaced by a distance X from a ledge 80 of the cylinder. At this location it contacts the tops of the associated push rods 25 and 26. The distances X (return) and Y (working stroke) may be equal or of a different amount depending upon the of combustion characteristics which are to be obtained. Upon further downward movement of the piston 2 from the position indicated in FIG. 1 the push rods 25 and 26 are moved downwardly so that the supply bores 25 and 23 are opened for the discharge of the associated propellant components into the combustion 58. By such an introduction of the propellant components the pressure will rise in the combustion chamber during the end phase of movement of the piston 2 and its return stroke, so that as the piston approaches a reversing position at the bottom dead center, a certain pressure $p1$ is exerted on the pressure differential piston 2 which imparts to the piston an immediate starting acceleration for its working stroke. At the same time, the fuel injection from the nozzles 16 and 17 becomes greater. During the initial upward movement in the working stroke, comparable to the phase distance Y, an additional amount of propellant is injected from the preinjection bores 19 and 20 because the control slots 25*a* and 26*a* will still be partially aligned with the passages 24 and 23 respectively. Thus the inertia pressure is still further increased. After the end of the return movement and during the beginning of the upward movement in the phase Y of the working stroke the pre-injection and the additional injection will be interrupted by the complete return of the push rods 25 and 26. In the further course of the working stroke the additional propellant which is injected by the nozzle means 16 and 1 7 will also be discontinued.

Figure 2:
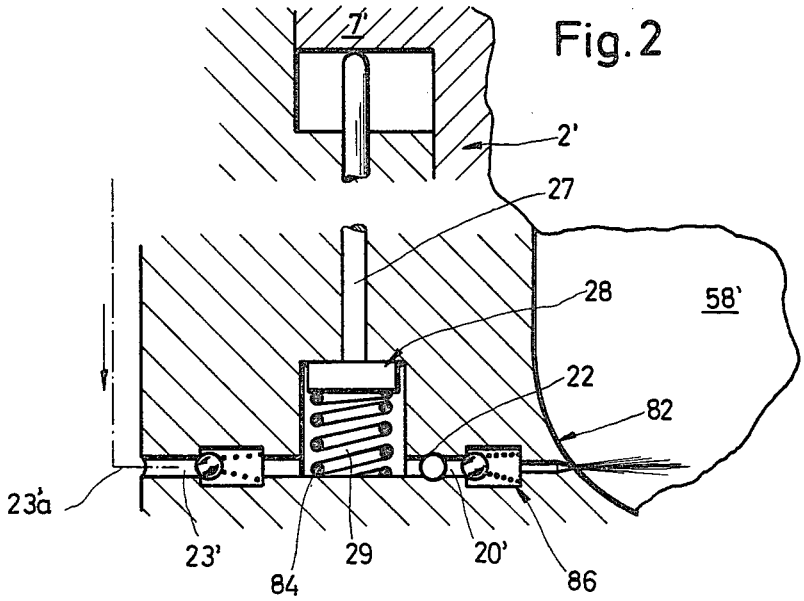
FIG. 2 is a partial axial sectional view of another embodiment of fire arms.
Figure 1A:
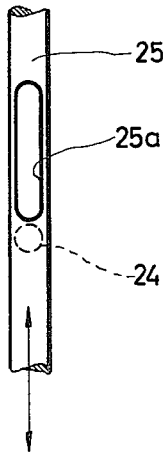
FIG. 1*a* is a section taken on the line 1*a*—1*a* of FIG. 1.
Figure 3:
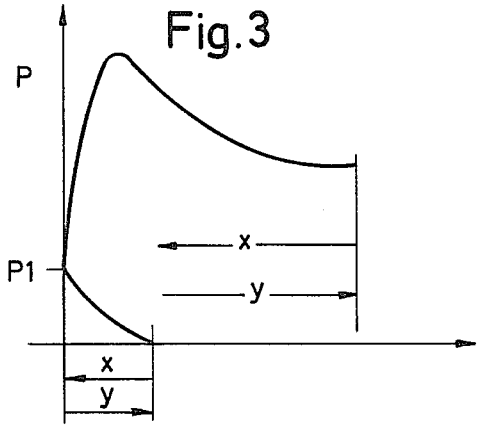
FIG. 3 indicates a pressure-path diagram of the combustion chamber system.

In the embodiment indicated in FIG. 2, similar parts are similarly designated for a driving force generating system generally designated 82. In this arrangement, the differential pressure piston 2' actuates, with an annular piston portion 7', drive pushers 27 of one or more injection pumps generally designated 28. The pumps 28 include a spring 84 which urges a pusher 27 upwardly and it includes a pumping space 29 which communicates with suction passages 23' and 23*a'* and discharge passages 20' which are connected with combustion chamber discharge nozzle means 86.

In each embodiment the pressure gases which are formed due to the combustion within the combustion chamber 58 or 58' drive a projectile 30 which has been inserted by means of suitable loading devices (not shown) into the barrel 52. The projectile 30 is moved out of high muzzle velocity according to the laws of inner ballistic.

As a starting position or rest position, there is provided a reversing point of the pressure differential piston 2 into which the piston is brought in each case by means of a spring (not shown) which acts in the direction of the arrow Y. A ring spring 31 forms a rear abutment for a pressure differential piston 2 for reversing the piston from the upward working stroke to the downward return stroke. The forward working stroke movement of the pressure differential piston 2 is also aided by the pressure of the tanks 8 and 9.

What is claimed is:

1. A driving force generating system, particularly for propelling a device such as a projectile in a fire arm, comprising wall means defining a combustion chamber, a piston movable in said combustion chamber, propellant component supply tank means, pump means connected between said supply tank means and said combustion chamber and being operable by movement of said piston in a working stroke to deliver propellant components into said combustion chamber, additional propellant supply means connected between said propellant supply tank means and said combustion chamber, nozzle means associated with said supply means for discharging the propellant into said combustion chamber, a control member disposed in the path of said piston, a spring biasing said control member in a direction to project it into the path of movement of said piston, said control member being contractable by said piston in a return movement to move it against the force of said spring to cause the discharge of propellant from said nozzle means for directing an additional amount of propellant components from said supply tank means into said combustion chamber toward the end of the return movement of said piston.

2. A driving force generating system, particularly for propelling a device such as a projectile in a fire arm, comprising wall means defining a combustion chamber, a piston movable in said combustion chamber, propellant component supply tank means, pump means connected between said supply tank means and said combustion chamber and being operable by movement of said piston in a working stroke to deliver propellant components into said combustion chamber, additional propellant supply means connected between said propellant supply tank means and said combustion chamber, nozzle means associated with said supply means for discharging the propellant into said combustion chamber, a control member disposed in the path of said piston, a spring biasing said control member in a direction to project it into the path of movement of said piston, said control member being contractable by said piston in a return movement to move it against the force of said spring to cause the discharge of propellant from said nozzle means for directing an additional amount of propellant components from said supply tank means into said combustion chamber toward the end of the return movement of said piston, including propellant component passage means defined in said piston and said walls means for delivering propellant components through said piston into said combustion chamber, said piston and said wall means defining a pumping chamber therebetween connected to said component supply tank means and providing a pumping action in respect to said chamber by movement of said piston during a working stroke and comprising said pump means.

3. A driving force generating system, for propelling a device such as a projectile comprising a tubular member defining a central combustion chamber which is adapted to be connected at one end to a fire arm barrel, a piston slidable in said combustion chamber, end plate means closing said tubular member and defining at the rear of said piston a plurality of pumping chambers which collapse upon movement of said piston in one direction and enlarge upon movement of said piston in said opposite direction, means for supplying individual propellant components to respective ones of said chambers, passage means connecting said chambers to said combustion chamber for injecting said propellant components into said combustion chambers during the movement of said piston in which the pumping chambers are collapsed, a plurality of control members of a number corresponding to the number of propellant components disposed in a path of movement of said piston and engageable by said piston during the return stroke thereof, and additional propellant component injection means for each of said propellant components connected to said control members and being actuable by movement of said control members by the return movement of said piston to provide an additional injection of propellant components into said combustion chamber.

4. A driving force generating system, according to claim 3, wherein said control members comprise elongated rods having a passage slot defined therethrough, said injection means including a conduit connected between a propellant storage tank and said combustion chamber, said control rod blocking said conduit but having a slot therein which may be aligned therewith when moved by said piston to provide passage of the propellant component through said conduit and into said combustion chamber.

5. A driving force generating syste, according to claim 3, including a gun barrel connected to said combustion chamber at the end opposite to said piston and adapted to contain projectile which is driven by the generation of combustion gases in said combustion chamber, and a return spring carried at the opposite end of said cylinder from said gun barrel and engageable with said piston to urge said piston in a return movement direction.

6. A driving force generating system, according to claim 3, wherein said additional propellant component injection means comprises a propellant component pump, a drive plunger member for said pump having a portion exposed in the path of movement of said piston and being movable by said piston to pump a propellant component into said combustion chamber.

7. A driving force generating system, according to claim 6, including valve means connected to said pump for facilitating inlet to said pump and discharge from said pump.

* * * * *